US007460069B2

(12) United States Patent
Park et al.

(10) Patent No.: US 7,460,069 B2
(45) Date of Patent: Dec. 2, 2008

(54) MONOPOLE ANTENNA APPLICABLE TO MIMO SYSTEM

(75) Inventors: Se-hyun Park, Suwon-si (KR); Byung-tae Yoon, Suwon-si (KR); Young-eil Kim, Suwon-si (KR); Young-min Moon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/489,457

(22) Filed: Jul. 20, 2006

(65) Prior Publication Data

US 2007/0115181 A1 May 24, 2007

(30) Foreign Application Priority Data

Nov. 23, 2005 (KR) ..... 10-2005-0112272

(51) Int. Cl.
*H01Q 1/38* (2006.01)

(52) U.S. Cl. ..... 343/700 MS; 343/846

(58) Field of Classification Search ..... 343/700 MS, 343/702, 846

See application file for complete search history.

(56) References Cited

U.S. PATENT DOCUMENTS 6,573,866 B2 6/2003 Chen
6,781,546 B2 * 8/2004 Wang et al. ..... 343/700 MS
2004/0201528 A1 * 10/2004 Lee et al. ..... 343/702
2005/0062654 A1 3/2005 Chen et al.
2007/0069956 A1 * 3/2007 Ozkar ..... 343/700 MS
2007/0069958 A1 * 3/2007 Ozkar ..... 343/700 MS

* cited by examiner

*Primary Examiner*—Hoang V Nguyen
(74) *Attorney, Agent, or Firm*—Sughrue Mion, PLLC

(57) ABSTRACT

A monopole antenna capable of implementing an MIMO system, which includes a ground part formed of plate metal, a monopole antenna element connected to one side of the ground part and formed of strips bent multiple times, an auxiliary antenna element connected to one side of the ground part and disposed adjacent to the monopole antenna element to electrically connect to the monopole antenna element, and a short-circuit part interconnecting the monopole antenna element and the auxiliary antenna element. Accordingly, the monopole antenna element is bent multiple times so that the antenna can become compact in less than half a width compared to the conventional antenna, and when the MIMO system is constructed, the interference between the respective antennas can be reduced so that the array antenna can become compact in size.

25 Claims, 8 Drawing Sheets

MONOPOLE ANTENNA APPLICABLE TO MIMO SYSTEM

CROSS-REFERENCE TO RELATED APPLICATIONS

This application claims priority from Korean Patent Application No. 10-2005-0112272, filed on Nov. 23, 2005, the entire contents of which are incorporated herein by reference.

BACKGROUND OF THE INVENTION

1. Field of the Invention

The present invention relates to a monopole antenna capable of implementing a multiple-input multiple-output (MIMO) system, and more particularly, to a monopole antenna capable of implementing an MIMO system, which may be compact in size and reduce interference between antennas upon MIMO system implementation.

2. Description of the Related Art

Conventional handheld terminals have an external antenna installed therein, and the external antenna may include such as a monopole antenna, helical antenna, and so on.

The monopole antenna is formed of a conductive rod, and the length of the antenna is determined based on a frequency band. Thus, the length of the antenna becomes longer than the handheld terminal since the antenna should have a certain length maintained regardless of the size of the handheld terminal. Further, the antenna can be damaged due to external shock since the antenna is externally exposed.

The helical antenna is formed of conductive coil wound around a conductive plate. The helical antenna has an advantage in that it can be configured to be shorter as compared to the monopole antenna, but also can be damaged due to external shock.

Such an external antenna is placed on the head of a user when the handheld terminal is used, so the user can be adversely affected by electromagnetic fields.

In order to overcome the drawback of such an external antenna, the inverted F antenna (PIFA) has been proposed.

FIG. 1A is a perspective view showing a related art inverted F antenna, and FIG. 1B is a cross-sectioned view of the inverted F antenna of FIG. 1A. As shown in FIGS. 1A and 1B, the inverted F antenna is three-dimensionally formed with a ground part 10, a radiation part 12, a connection part 14, and a power supply part 16.

The radiation part 12 is disposed on the upper side of the ground part 10, and the connection part 14 is disposed on the end portion of the radiation part 12, and thus connects the ground part 10 to the radiation part 12. The power supply part 16 supplies electric current to the radiation part 12. In general, the impedance matching is determined based on the location of the power supply part 16 and the length of the connection part 14. The size of such a conventional inverted F antenna approximately becomes 15 mm×15 mm×6 mm.

Such an inverted F antenna can be built as an internal antenna in a handheld terminal, considerably resolving the drawback and providing easier fabrication as compared to the external antenna.

However, the conventional inverted F antenna has a problem in that there exists limitations to compactness and light weight in respect to the interval and sizes of the radiation part and the ground part. Further, the conventional inverted F antenna has a problem since a complicated fabrication or production process is taken due to the structure of the ground part and the structure of a power supply part and a separate supporting member is needed to support the radiation part.

FIG. 2 is a perspective view showing an antenna disclosed in U.S. Patent Application Publication No. 2005-62654, entitled 'Planar Inverted F Antenna (PIFA)'. As shown in FIG. 2, the antenna disclosed in the patent publication is constructed with the ground plate 25 and a pair of inverted F antennas 20, and selection and usage is made from one of signals received at each inverted F antenna 20, using diversity characteristics.

However, in the above patent publication, the pair of inverted F antennas 20 is arranged in a row so that the whole length of the antenna becomes long, which causes difficulties in arranging plural inverted F antennas. Further, since the interval between the inverted F antennas 20 is narrow, the interference between the inverted F antennas 20 inevitably occurs. In particular, a certain size of ground plate is needed for each of inverted F antennas 20, so it is impossible to apply the inverted F antennas 20 to small-scale terminals.

FIG. 3 is a perspective view showing an antenna disclosed in U.S. Pat. No. 6,573,866, entitled 'Multi-Frequency Hidden Antenna for Mobile Phones'. As shown in FIG. 3, U.S. Pat. No. 6,573,866 discloses a multi-frequency antenna using an electric power supply manner of the coplanar waveguide antenna having ground parts on the same plane as the electric power supplying line. The antenna 34 is connected to the electric power supplying line 33 supplied with electric power from the electric power supplying point 35, and the pair of ground parts 31 and 32 is disposed on the same plane as and spaced apart in a certain distance from the electric power supplying line 33. Further, the flattened short circuit 37 connecting the electric power supplying line 33 with the ground part 32 is provided so that a frequency is determined depending on a location of the flattened short circuit 37, which enables multi-frequency implementation.

However, such a conventional antenna, like the other conventional antenna stated as above, has a drawback since it has to maintain the lengths of the electric power supplying line 33 and the antenna 34 over a certain length, and has difficulties in application to small-scale terminals due to the electric power supplying structure of the coplanar waveguide antenna.

Meanwhile, there has been proposed the MIMO antenna having plural antenna elements arranged in a special structure and performing multiple-input and multiple-output operations. The MIMO system combines radiation patterns of the plural antenna elements and combines radiation power of the plural antenna elements, to sharpen the shape of the whole radiation pattern and then have an electromagnetic wave travel much farther.

However, such an MIMO system requires many small antenna elements in order that the plural antenna elements are mounted in a small-scale terminal, which is very difficult in realization with the above conventional antennas.

Thus, much smaller antennas are required as small-scale terminals become more compact, and in particular, the structure of small antenna elements has to be proposed which can realize the MIMO system.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

The present invention provides a monopole antenna which can be miniaturized and thus realize an MIMO system in a compact terminal.

According to an aspect of the present invention, a monopole antenna is provided, comprising a ground part formed of plate metal; a monopole antenna element connected to one side of the ground part, and formed of strips bent multiple times; an auxiliary antenna element connected to one side of the ground part, and disposed adjacent to the monopole antenna element to electrically connect to the monopole antenna element; and a short-circuit part interconnecting the monopole antenna element and the auxiliary antenna element.

The monopole antenna element may be formed with first, second, and third radiation strips connected together and bent in order, the first radiation strip protruding from the end portion of the ground part, the second radiation strip having one end connected to the other end of the first radiation strip and being bent from the first radiation strip, and the third radiation strip having one end connected to the other end of the second radiation strip and being bent from the second radiation strip.

The third radiation strip may be shorter than the first radiation strip, and spaced apart in a predetermined distance from the ground part.

The total length of the first to third radiation strips of the monopole antenna may be ½λ.

Each length of the first to third radiation strips may be adjusted so that the total length of the first to third radiation strips of the monopole antenna is ½λ.

The auxiliary antenna element may be formed in a strip shape disposed in parallel with the first and third radiation strips.

The short-circuit part may connect the first radiation strip of the monopole antenna element with the auxiliary antenna element.

An interval between the first radiation strip and the auxiliary antenna element may be determined by an S-parameter.

The interval between the first radiation strip and the auxiliary antenna element ranges from 0.0035λ to 0.0175λ.

A height of the short-circuit part from the ground part may be determined by the S-parameter.

The height of the short-circuit part from the ground part may be determined in a state of an optimum interval between the first radiation strip and the auxiliary antenna element.

The height of the short-circuit part from the ground part ranges from 0.0325λ to 0.0613λ if the interval between the first radiation strip and the auxiliary antenna element ranges from 0.0062λ to 0.0105λ.

A length of the auxiliary antenna element may be determined by the S-parameter.

The length of the auxiliary antenna element may be determined in a state of an optimum height of the short-circuit part from the ground part.

The length of the auxiliary antenna element may be longer than the height of the short-circuit part from the ground part.

The length of the auxiliary antenna element ranges from 0.0788λ to 0.0876λ.

The first to third radiation strips, the auxiliary antenna element, and the short-circuit part may be formed on the same plane as the ground part.

The second radiation strip may be bent from the first radiation strip to protrude upwards from the plane of the ground part, and the third radiation strip may be bent from the second radiation strip.

The ground part may be formed of a printed circuit board (PCB) mounted in a terminal.

An MIMO system may be configured to include more than one ground part, monopole antenna element, auxiliary antenna element, and/or short-circuit part.

According to another aspect of the present invention, a MIMO antenna is provided, comprising plural ground parts formed of plate metal; plural monopole antennas each connected to one side of each of the ground parts, and formed of strips bent multiple times; plural auxiliary antenna elements each connected to one side of each of the ground parts, and disposed adjacent to each of the monopole antenna elements to electrically connect to each of the monopole antenna elements; and plural short-circuit parts each interconnecting each of the monopole antenna elements and each of the auxiliary antenna elements.

The monopole antenna elements may be spaced apart over a predetermined distance from one another.

A slit of a predetermined length may be formed from an end portion of the ground part between neighboring ground parts to separate the neighboring ground parts.

BRIEF DESCRIPTION OF THE DRAWINGS

The above and other aspects of the present invention will be more apparent by describing exemplary embodiments of the present invention with reference to the accompanying drawings, in which.

DETAILED DESCRIPTION OF THE EXEMPLARY EMBODIMENTS

Hereinafter, exemplary embodiments of the present invention will be described in detail with reference to the accompanying drawings.

Figure 1A:
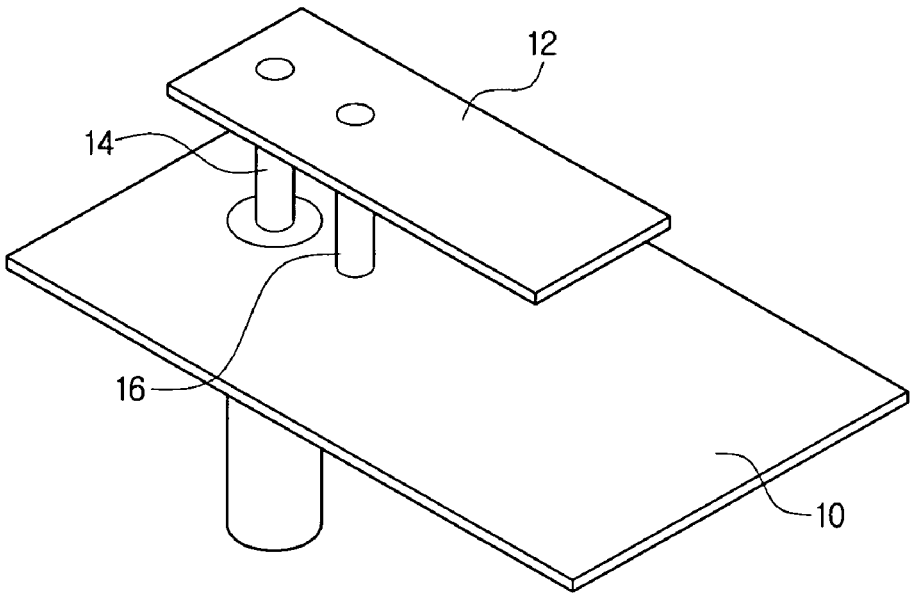
FIG. 1A (RELATED ART)
FIG. 1A is a perspective view showing a related art general inverted F antenna.
Figure 1B:
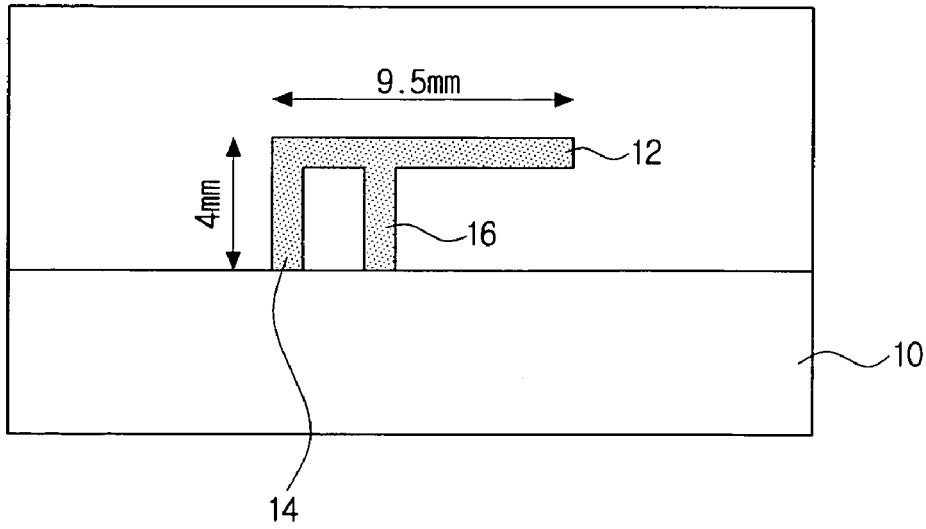
FIG. 1B (RELATED ART)
FIG. 1B is a cross-sectioned view showing the inverted F antenna of FIG. 1A.
Figure 2:
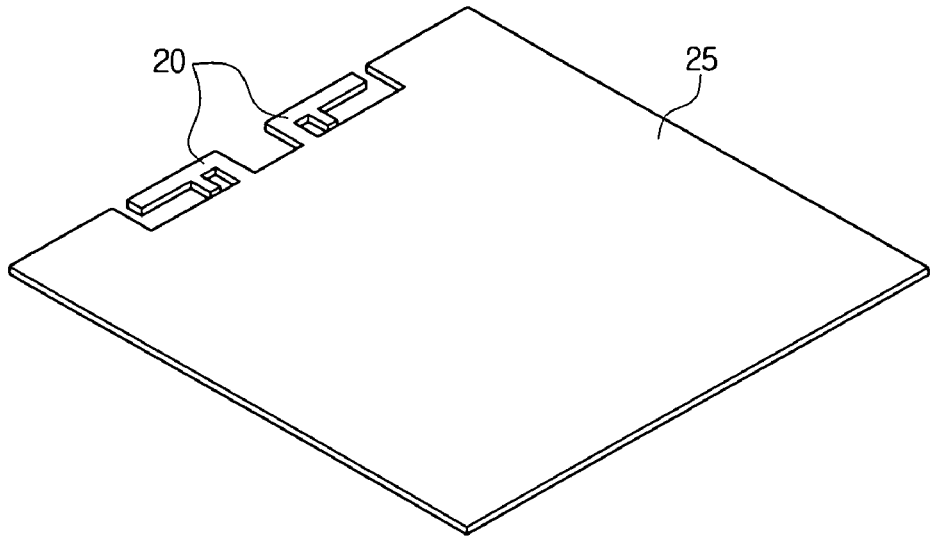
FIG. 2 (RELATED ART)
FIG. 2 is a perspective view showing a related art planar inverted F antenna.
Figure 3:
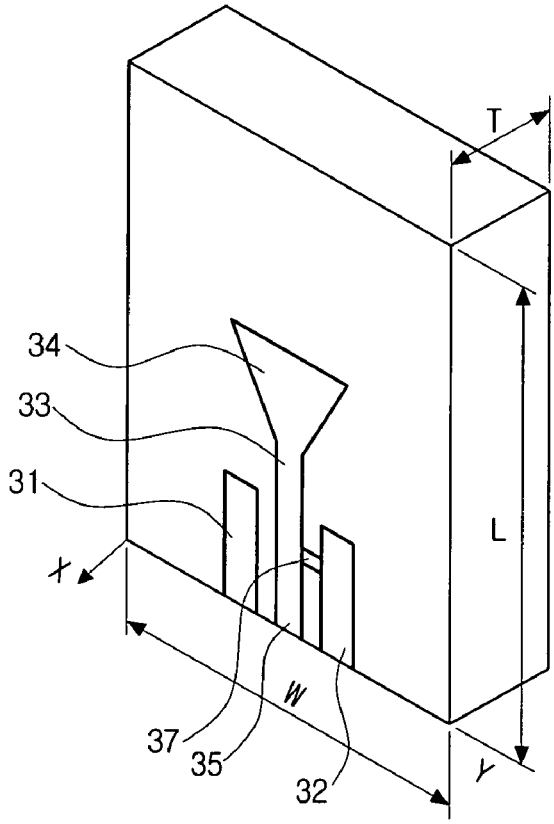
FIG. 3 (RELATED ART)
FIG. 3 is a perspective view showing a related art multi-frequency hidden antenna for mobile phones.
Figure 4:
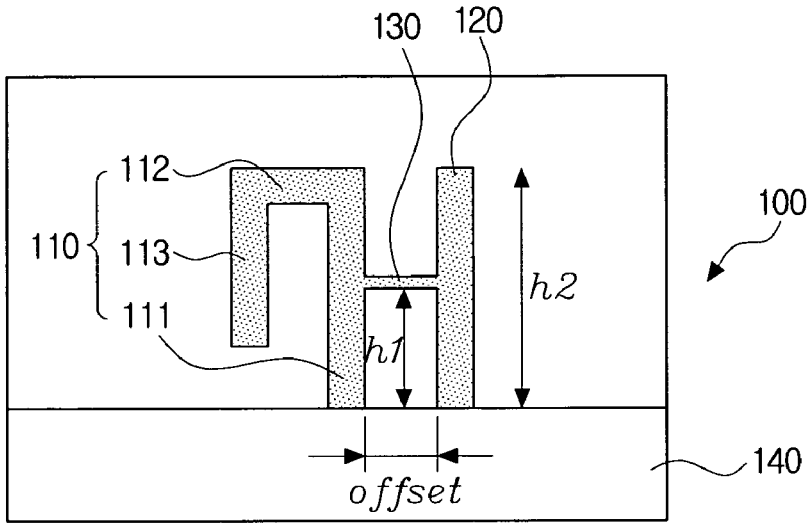
FIG. 4 is a plan view showing a monopole antenna according to an exemplary embodiment of the present invention.

FIG. 4 is a plan view showing a monopole antenna according to an exemplary embodiment of the present invention. As shown in FIG. 4, the monopole antenna has a monopole antenna element 110, an auxiliary antenna element 120, a short-circuit part 130, and a ground part 140.

The ground part 140 can be formed in a planar shape and in a separate manner, but in the present exemplary embodiment, the ground part 140 is provided on a board, for example, a printed circuit board mounted in the small-scale terminal. Accordingly, space necessary for the monopole antenna 100 to be mounted therein becomes small since the ground part 140 is not separately provided.

The monopole antenna element 110 is supplied with a predetermined high-frequency signal through the power supply point, and radiates an electromagnetic wave. The monopole antenna element 110 has the power supply point formed on its one end connected to the ground part 140, and the monopole antenna element 110 is formed on the same plane as the ground part 140. The monopole antenna element 110 is formed with first to third radiation strips 111, 112, and 113, and the first to third radiation strips are sequentially connected and bent with respect to one another. The first radiation strip 111 is connected to the ground part 140 on one end portion thereof, and protrudes perpendicular to the end portion of the ground part 140. The second radiation strip 112 is connected to the other end portion of the first radiation strip 111 on one end portion thereof, and bent perpendicular to the first radiation strip 111 to be parallel with the ground part 140. The third radiation strip 113 is connected to the other end portion of the second radiation strip 112, and bent perpendicular to the second radiation strip 112 to be parallel with the first radiation strip 111. The third radiation strip 113 is formed shorter than the first radiation strip 111 and spaced apart in a predetermined distance from the ground part 140.

The operation frequency is determined depending on the lengths of the first to third radiation strips 111, 112, and 113 of the monopole antenna element 110, and the lengths of the first to third radiation strips 111, 112, and 113 are set to ½λ. In here, λ is a wavelength of a signal to be emitted from the present monopole antenna 100.

As the first to third radiation strips 111, 112, and 113 of the present monopole antenna element 110 are bent with respect to one another, the radiation part has a length of ¼λ, and thus, compared to an antenna width of 9 mm, the present embodiment can reduce the width of the monopole antenna 100 to ⅛λ with the monopole antenna element 110 bent in three sections. That is, the monopole antenna 100 can become more compact. Depending on various structures and conditions of a small-scale terminal in which the monopole antenna 100 is mounted, it has an advantage of free designs since the lengths of the first to third radiation strips can be adjusted in the range of the total length of the monopole antenna element 110.

The auxiliary antenna element 120 emits electromagnetic waves together with the monopole antenna element 110, one end portion of the auxiliary antenna element 120 is connected to the ground part 140 and protrudes perpendicular to the end portion of the ground part 140. Further, the auxiliary antenna element 120 is formed on the same plane as the ground part 140, and formed parallel with the first and third radiation strips 111 and 113 of the monopole antenna element 110.

The short-circuit part 130 connects the monopole antenna element 110 to one portion of the auxiliary antenna element 120, and the short-circuit part 130 is formed at a location having the optimum impedance.

The impedance matching is realized by use of the auxiliary antenna element 120 and the short-circuit part 130, and the operation frequency is determined by the length of the auxiliary antenna element 120 and the location of the short-circuit part 130. In here, the distance between the monopole antenna element 110 and the auxiliary antenna element 120 is first established, and thus the length of the auxiliary antenna element 120 and the location of the short-circuit part 130 are adjusted for impedance matching.

Figure 5A:
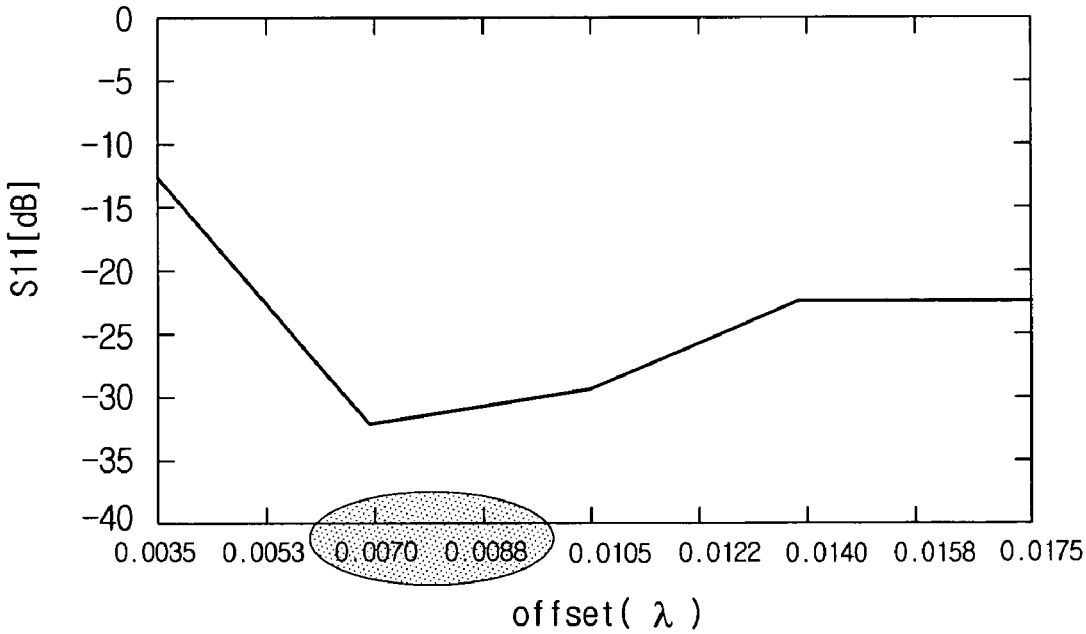
FIG. 5A is a graph showing relations between an S-parameter and an offset between the monopole antenna element and an auxiliary antenna element.

FIG. 5A is a graph showing relations between a transistor scattering parameter (S-parameter) and an offset between the monopole antenna element and an auxiliary antenna element. As shown in FIG. 5A, the S-parameter varies according to the offset between the first radiation strip 111 of the monopole antenna element 110 and the auxiliary antenna element 120, and the S-parameter becomes the lowest if the offset between the monopole antenna element 110 and the auxiliary antenna element 120 is in the range of 0.0070λ to 0.0088λ.

Meanwhile, in general, the maximum S-parameter of −10 dB is required after an antenna is mounted in a terminal, and to do so, the S-parameter of the antenna is set to below −20 dB before the antenna is mounted in the terminal. Therefore, since the S-parameter is below −20 dB if the offset between the monopole antenna element 110 and the auxiliary antenna element 120 is approximately over 0.0044λ, the performance of the monopole antenna 100 can be guaranteed if in the range of over 0.0044λ to below 0.0175λ, and in this range, the offset between the monopole antenna element 110 and the auxiliary antenna element 120 can be determined.

Figure 5B:
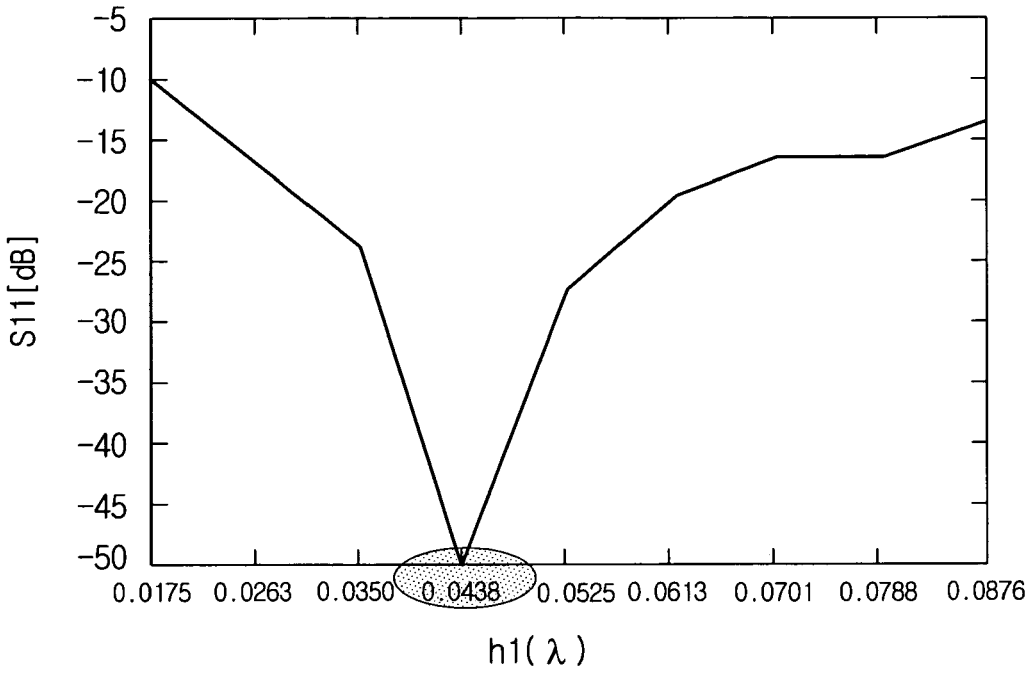
FIG. 5B is a graph showing relations between S-parameters and heights h1 from ground parts of a short-circuit part.

FIG. 5B is a graph showing relations between S-parameters and heights h1 from the ground part 140 of the short-circuit part 130, the reference of which is made when the offset between the monopole antenna element 110 and the auxiliary antenna element 120 is 0.0088λ as a result shown in FIG. 5A. If the height h1 of the short-circuit part 130 is in the range of 0.0315λ to 0.0613λ, the S-parameter becomes less than −20 dB so that the height h1 of the short-circuit part 130 can be determined in this range. Since the S-parameter becomes the lowest at the time the h1 of the short-circuit part 130 is 0.0438λ in the range, it is preferable to set the h1 of the short-circuit part 130 to 0.0438λ.

Figure 5C:
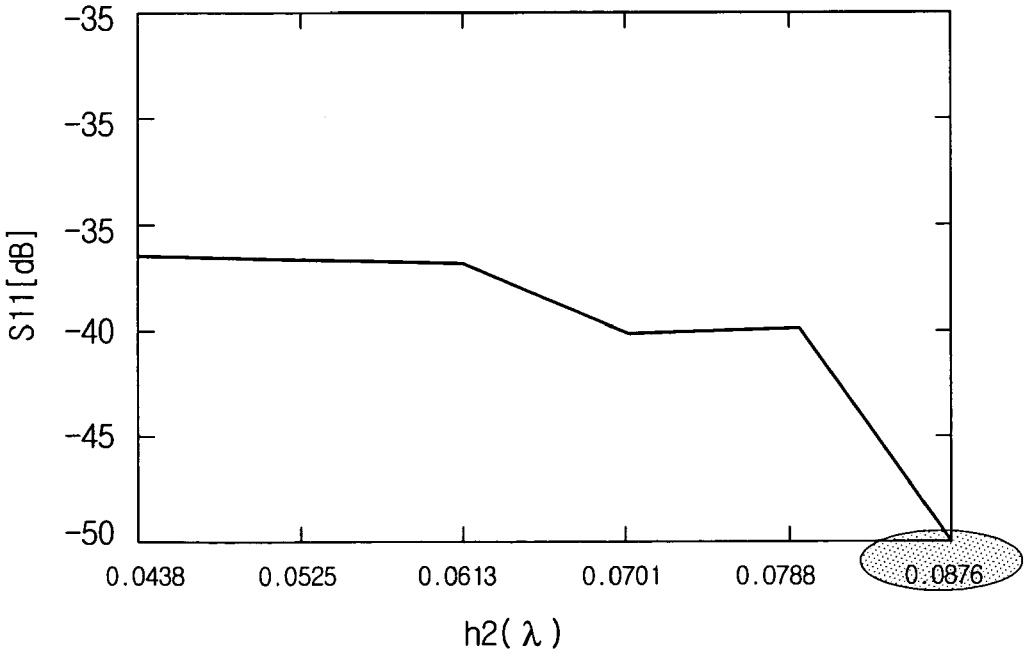
FIG. 5C is a graph showing relations between S-parameters and lengths h2 of an auxiliary antenna element.

FIG. 5C is a graph showing relations between the length h2 of the auxiliary antenna element 120 and the S-parameter. The relations between the length h2 of the auxiliary antenna element 120 and the S-parameter are measured in the conditions that the offset between the monopole antenna element 110 and the auxiliary antenna element 120 is 0.0088λ and the height h1 of the short-circuit part 130 is 0.0438λ.

The S-parameter becomes smaller as the h2 of the auxiliary antenna element 120 becomes longer, and since the S-parameter is less than −20 dB in the range of 0.0438λ to 0.0876λ, the length h2 of the auxiliary antenna element 120 can be determined in this range. As shown in FIG. 5C, the length h2 of the auxiliary antenna element 120 becomes the least at 0.0876λ, thus the length h2 of the auxiliary antenna element 120 is set to 0.0876λ.

In here, the offset between the monopole antenna element 110 and the auxiliary antenna element 120 can be adjusted in the range of over 0.0044λ to below 0.0175λ, and thus the height h1 of the short-circuit part 130 and the length h2 of the auxiliary antenna element 120 can be adjusted.

Figure 6:
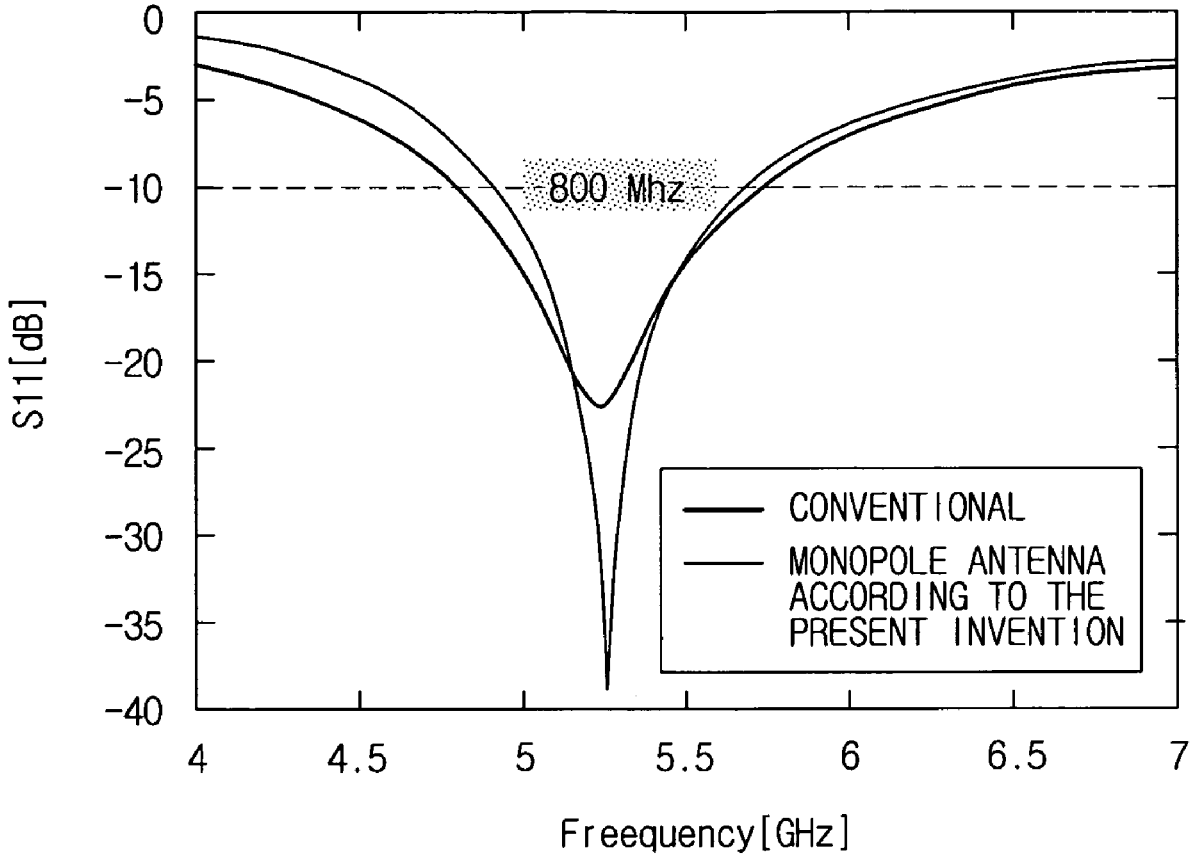
FIG. 6 is a graph showing relations between S-parameters and operational frequencies of the conventional antenna and the monopole antenna of an exemplary embodiment of the present invention.

FIG. 6 is a graph showing relations between the operation S-parameters and operational frequencies of the conventional antenna and the monopole antenna 100 of the present invention. As shown in FIG. 6, the antenna of the present invention and the conventional antenna all operate in nearly the same bandwidth, that is, at 5.25 MHz, but it can be seen that the S-parameter of the present invention is much smaller as compared to the conventional one. Further, since the conventional operational frequency bandwidth is 900 MHz and the operational frequency bandwidth of the monopole antenna of the present invention is 800 MHz, at −10 dB being the S-parameter reference, it can be seen that there is no big change in bandwidth.

Figure 7:
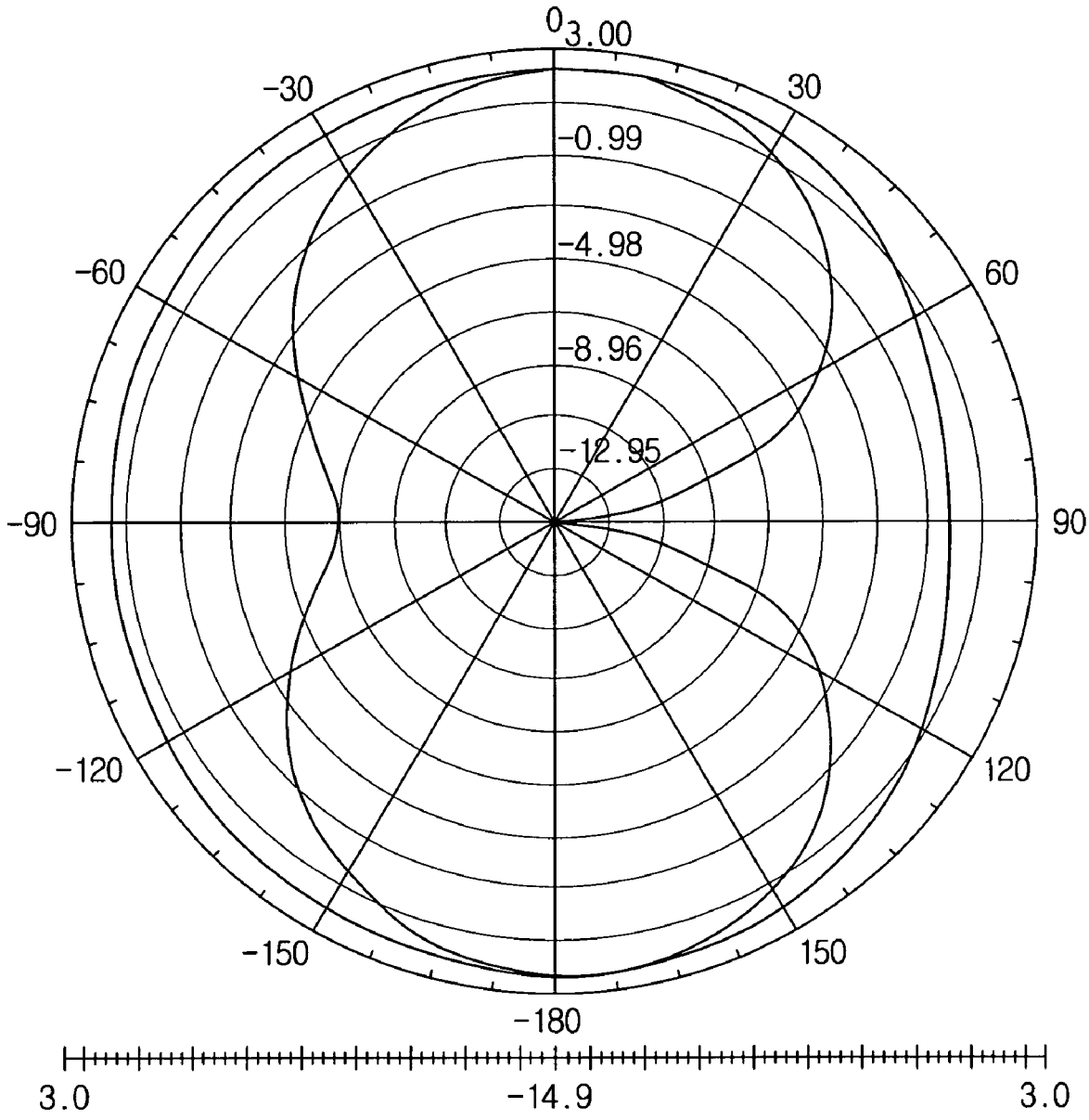
FIG. 7 is a graph showing a radiation pattern of an electromagnetic wave radiating from the monopole antenna of an exemplary embodiment of the present invention.

FIG. 7 is a graph showing a radiation pattern of electromagnetic waves radiating from the monopole antenna 100 antenna of the present invention. In general, the radiation pattern is referred to as an effective region in which antennas can radiate or detect the electromagnetic waves. As shown in FIG. 7, although the monopole antenna 100 of the present invention is shortened by 50% in its width as compared to the conventional antenna, the monopole antenna 100 of the present invention forms a omni-directional radiation pattern similar to the conventional antenna.

Figure 8:
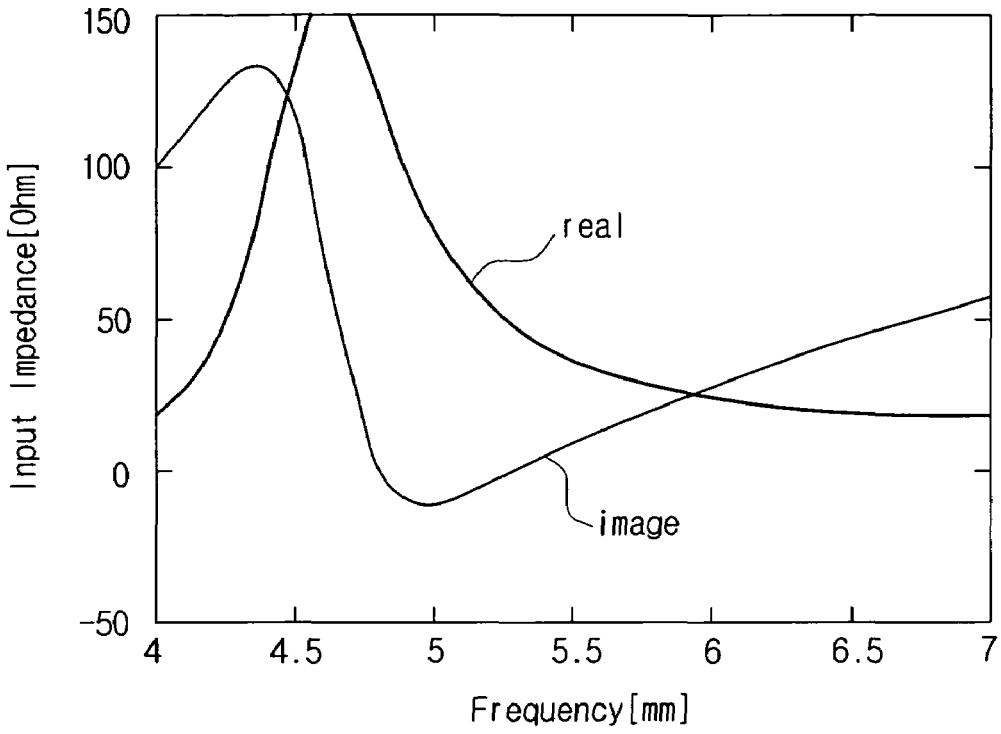
FIG. 8 is a graph comparing ideal input impedance with input impedance of the monopole antenna of an exemplary embodiment of the present invention.

FIG. 8 is a graph comparing ideal input impedance with input impedance of the monopole antenna 100 of the present invention. As shown in FIG. 8, in the monopole antenna 100 of an exemplary embodiment of the present invention, the real part of the impedance at 5.25 GHz is matched in 50Ω, and thus resonance occurs which is achieved with the impedance matching of the auxiliary antenna element 120 and the short-circuit part 130.

Figure 9:
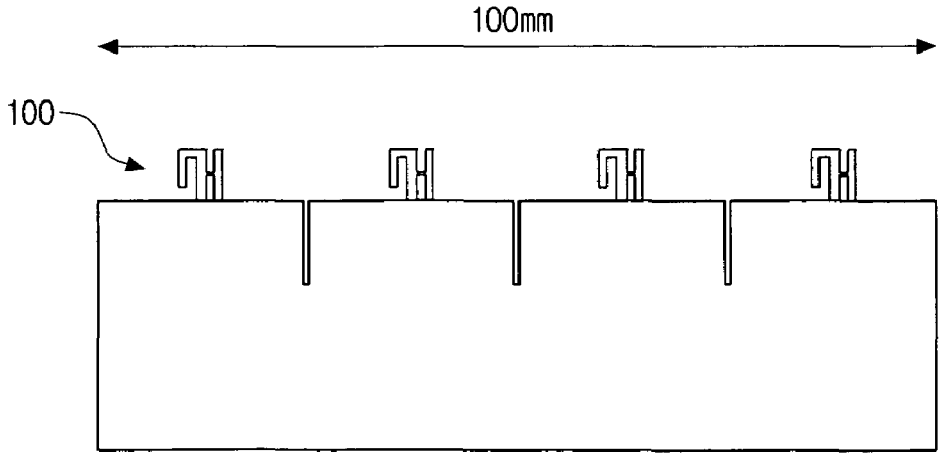
FIG. 9 is a plan view of an MIMO array antenna built with plural monopole antenna arranged in a configuration, according to an exemplary embodiment of the present invention.

FIG. 9 is a plan view of an MIMO array antenna structured with plural monopole antennas arranged in a configuration, according to an exemplary embodiment of the present invention. As shown in FIG. 9, the MIMO array antenna is formed with the four monopole antennas 100 arranged in a row, and the ground parts 140 of the respective monopole antennas 100 are connected as one. However, slits are formed between neighboring ground parts 140, so the effect of substantially dividing the ground parts 140 can be obtained.

In general, the MIMO array antenna is constructed with the plural monopole antennas 100, so there exists a problem of distortion of its radiation pattern caused by interference between the respective monopole antennas 100.

However, if the MIMO system is built with the present monopole antenna 100 used as above, each monopole antenna 100 is small in size, so plural antennas can be fully mounted on one side of a small terminal. Actually, the MIMO system shown in FIG. 9 has a whole width of less than 100 mm, so it can be fully mounted in a compact terminal such as PDA. Further, since the respective monopole antennas 100 are fully spaced apart in distance so that the interference among the respective monopole antennas 100 can be reduced, the radiation pattern distortion can be prevented.

Figure 10:
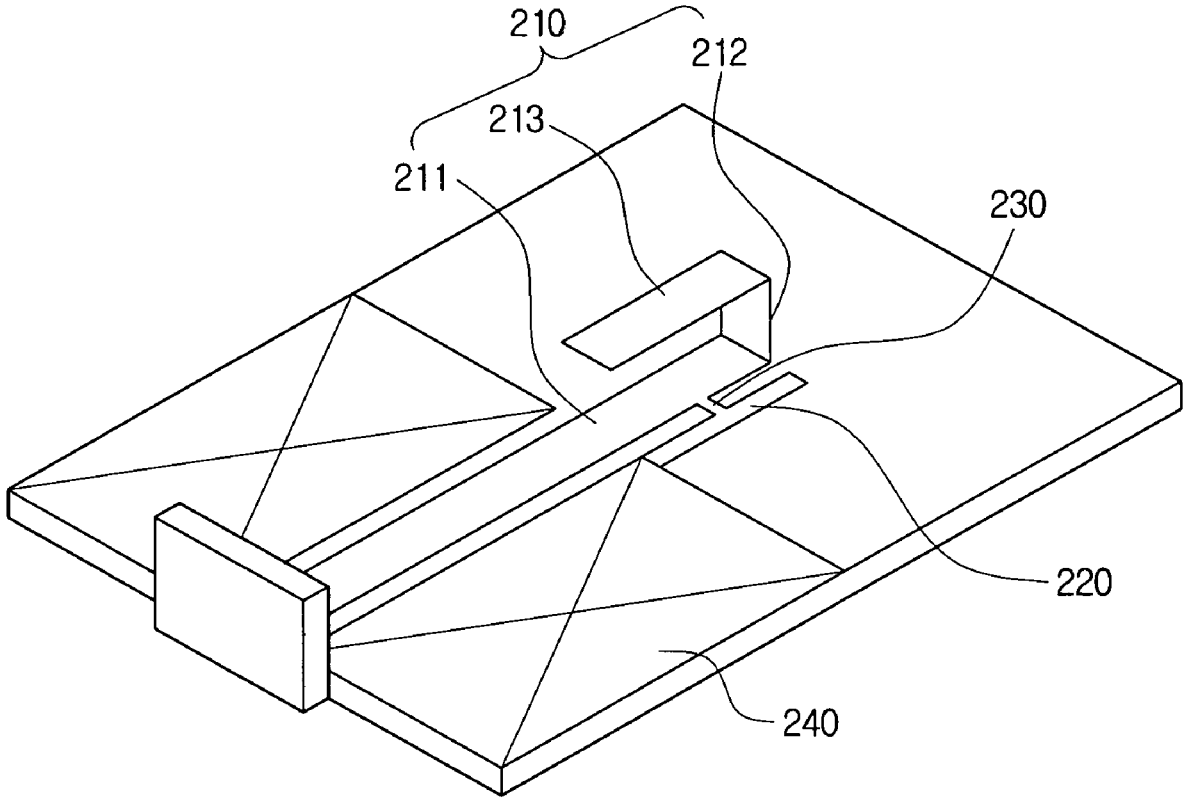
FIG. 10 is a perspective view for showing a monopole antenna built in three-dimensions according to an exemplary embodiment of the present invention.

FIG. 10 is a perspective view showing a monopole antenna built in three-dimensions according to an exemplary embodiment of the present invention. As shown in FIG. 10, the three-dimensional monopole antenna has a structure similar to the above monopole antenna 100 in that the three-dimensional monopole antenna has a monopole antenna element 210, an auxiliary antenna element 220, a short-circuit part 230, and a ground part 240.

However, in the three-dimensional monopole antenna, the second and third radiation strips 212 and 213 of the monopole antenna element 210 are not formed on the same plane as the ground part 240. That is, when the first radiation strip 211 is bent to form the second radiation strip 212, the second radiation strip 212 is bent and protrudes perpendicular to the plane of the ground part 240. Further, the third radiation strip 213 is formed in parallel with the first radiation strip 211, and thus the monopole antenna has the three-dimensional shape by the second and third radiation strips 212 and 213 protruding in a third dimension.

In FIG. 10, the ground part 240 is formed on both sides with respect to the first radiation strip 211 of the monopole antenna element 210, and the first radiation strip 211 and the ground part 240 are spaced apart in a predetermined interval, so that the coplanar waveguide (CPW)-fed method is applied. However, as in the above exemplary embodiment, it is obvious that the ground plate can be formed in one body with the substrate.

As stated above, according to exemplary embodiments of the present invention, the monopole antenna element is bent multiple times so that the antenna becomes compact in less than half a width compared to the conventional antenna, and the impedance matching is carried out by using the auxiliary antenna element and the short-circuit part. Accordingly, as the interval between the respective antennas forming an array antenna becomes widened when the MIMO system is constructed, the interference between the respective antennas can be reduced so that the array antenna can become compact in size.

Further, the monopole antenna has first to third radiation strips of which lengths can be randomly adjusted as well as be formed into a three-dimensional structure, so that the antenna can be designed to be optimized depending on the standard or the condition of small-scale terminals. Further, since the monopole antenna does not need any separate ground part, instead using the substrate of the small-scale terminals as the ground part, the cost can be reduced and the waste of space due to the installation of the ground part can be prevented.

Further, exemplary embodiments of the present invention have been described, which should be considered as illustrative, and various changes and modifications can be made without departing from the technical spirit of the present invention. Accordingly, the scope of the present invention should not be limited by the exemplary embodiments, but should be defined by the appended claims and equivalents.

What is claimed is:

1. A monopole antenna comprising:

a ground part formed of a printed circuit board (PCB);

a monopole antenna element connected to the ground part at a first portion of the monopole antenna element, the monopole antenna comprising at least one strip bent multiple times;

an auxiliary antenna element connected to the ground part at a first portion of the auxiliary antenna element, and disposed adjacent to the monopole antenna element to electrically connect to the monopole antenna element; and a short-circuit part interconnecting the monopole antenna element and the auxiliary antenna element at a second portion of the monopole antenna element and a second portion of the auxiliary antenna element, wherein said second portions of said monopole antenna element and auxiliary antenna element, are different from said first portions of said monopole antenna element and auxiliary antenna element, respectively.

2. The monopole antenna as claimed in claim 1, wherein the monopole antenna element comprises first, second, and third radiation strips connected together.

3. The monopole antenna as claimed in claim 2, wherein the first radiation strip protrudes from an end portion of the ground part, the second radiation strip has one end connected to a protruding end of the first radiation strip and is bent in a direction perpendicular to the first, radiation strip, and the third radiation strip has one end connected to the other end of the second radiation strip and is bent in a direction perpendicular to the second radiation strip.

4. The monopole antenna as claimed in claim 3, wherein the third radiation strip is shorter than the first radiation strip, and spaced apart a predetermined distance from the ground part.

5. The monopole antenna as claimed in claim 3, wherein the total length of the first to third radiation strips of the monopole antenna is ½ÿ.

6. The monopole antenna as claimed in claim 3, wherein each length of the first to third radiation strips is adjusted so that the total length of the first to third radiation strips of the monopole antenna is ½.

7. The monopole antenna as claimed in claim 3, wherein the auxiliary antenna element is formed in a strip shape disposed in parallel with the first and third radiation strips.

8. The monopole antenna as claimed in claim 7, wherein the short-circuit part connects the first radiation strip of the monopole antenna element with the auxiliary antenna element.

9. The monopole antenna as claimed in claim 3, wherein an interval between the first radiation strip and the auxiliary antenna element is determined by an S-parameter.

10. The monopole antenna as claimed in claim 9, wherein the interval between the first radiation strip and the auxiliary antenna element ranges from 0.0035ÿ to 0.0175ÿ.

11. The monopole antenna as claimed in claim 9, wherein the interval between the first radiation strip and the auxiliary antenna element ranges from 0.0062ÿ to 0.0105ÿ.

12. The monopole antenna as claimed in claim 3, wherein a height of the short-circuit part from the ground part is determined by an S-parameter.

13. The monopole antenna as claimed in claim 12, wherein the height of the short-circuit part from the ground part is determined in a state of an optimum interval between the first radiation strip and the auxiliary antenna element.

14. The monopole antenna as claimed in claim 13, wherein the height of the short-circuit part from the ground part ranges from 0.0325ÿ to 0.0613ÿ if the interval between the first radiation strip and the auxiliary antenna element ranges from 0.0062ÿ to 0.0105ÿ.

15. The monopole antenna as claimed in claim 3, wherein a length of the auxiliary antenna element is determined by an S-parameter.

16. The monopole antenna as claimed in claim 15, wherein the length of the auxiliary antenna element is determined in a state of an optimum height of the short-circuit part from the ground part.

17. The monopole antenna as claimed in claim 16, wherein the length of the auxiliary antenna element is longer than a height of the short-circuit part from the ground part.

18. The monopole antenna as claimed in claim 15, wherein the length of the auxiliary antenna element ranges from 0.0788ÿ to 0.0876ÿ.

19. The monopole antenna as claimed in claim 2, wherein the first to third radiation strips, the auxiliary antenna element, and the short-circuit part are formed on the same plane as the ground part.

20. The monopole antenna as claimed in claim 2, wherein the second radiation strip is bent in a direction perpendicular to the first radiation strip to protrude upwards from a plane of the ground part, and the third radiation strip is bent in a direction perpendicular to the second radiation strip.

21. The monopole antenna as claimed in claim 1, wherein the ground part is formed of a printed circuit board (PCB) mounted in a terminal.

22. The monopole antenna as claimed in claim 1, wherein the ground part, the monopole antenna element, the auxiliary antenna element, and the short-circuit part are disposed in plural, in order for a multiple-input multiple-output (MIMO) system to be configured.

23. A multiple-input multiple-output (MIMO) antenna comprising:

a plurality of ground parts formed of plate metal;

a plurality of monopole antennas each connected to a respective one of the ground parts, the plurality of monopole antennas comprising strips bent multiple times;

a plurality of auxiliary antenna elements each connected to the respective one of the ground parts, and disposed adjacent to a respective one of the monopole antenna elements to electrically connect to the monopole antenna elements; and a plurality of short-circuit parts each interconnecting each of the monopole antenna elements and a respective one of the auxiliary antenna elements.

24. The MIMO antenna as claimed in claim 23, wherein the monopole antenna elements are spaced apart over a predetermined distance from one another.

25. The MIMO antenna as claimed in claim 23, wherein a slit of a predetermined length is formed from an end portion of each ground part between neighboring ground parts to separate the neighboring ground parts.

* * * * *